US011322289B2

(12) United States Patent
Findeisen

(10) Patent No.: US 11,322,289 B2
(45) Date of Patent: May 3, 2022

(54) ELECTRICAL DEVICE HAVING ENCAPSULATED SPACES COOLED WITH DIFFERENT INTENSITY

(71) Applicant: Siemens Energy Global GmbH & Co. KG, Munich (DE)

(72) Inventor: Joerg Findeisen, Dresden (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 454 days.

(21) Appl. No.: 16/340,266

(22) PCT Filed: Sep. 15, 2017

(86) PCT No.: PCT/EP2017/073248

§ 371 (c)(1),
(2) Date: May 1, 2019

(87) PCT Pub. No.: WO2018/065188

PCT Pub. Date: Apr. 12, 2018

(65) Prior Publication Data

US 2019/0259521 A1 Aug. 22, 2019

(30) Foreign Application Priority Data

Oct. 6, 2016 (DE) ..... 10 2016 219 378.3

(51) Int. Cl.
*H01F 27/12* (2006.01)
*H01F 27/14* (2006.01)
(Continued)

(52) U.S. Cl.
CPC ..... *H01F 27/14* (2013.01); *H01F 27/025* (2013.01); *H01F 27/10* (2013.01); *H01F 27/12* (2013.01);
(Continued)

(58) Field of Classification Search
CPC ..... H01F 27/14; H01F 27/12; H01F 27/025; H01F 27/322; H01F 27/402; H01F 2027/406; H01F 27/10
See application file for complete search history.

(56) References Cited

U.S. PATENT DOCUMENTS 3,144,770 A * 8/1964 Sheely ..... H01F 27/402 374/152
3,902,146 A * 8/1975 Muralidharan ..... H01F 27/322 336/57
(Continued)

FOREIGN PATENT DOCUMENTS

DE 2016508 A1 10/1972
DE 2738398 A1 3/1979
(Continued)

*Primary Examiner* — Tuyen T Nguyen
(74) *Attorney, Agent, or Firm* — Laurence A. Greenberg; Werner H. Stemer; Ralph E. Locher

(57) ABSTRACT

An electrical device for connecting to a high-voltage network has a vessel, which is filled with an insulating fluid, an active part, which is arranged in the vessel and which has a magnetizable core and partial windings for producing a magnetic field in the core, and a cooling apparatus for cooling the insulating fluid. The electrical device can be operated at high temperatures. At least one barrier system is provided, which at least partly delimits encapsulated spaces, in each of which at least one partial winding is arranged, the barrier system guiding the insulating fluid cooled by the cooling apparatus across the encapsulated spaces in such a way that different encapsulated-space temperatures arise in the encapsulated spaces.

13 Claims, 4 Drawing Sheets

(51) Int. Cl.

| | |
|---|---|
| ***H01F 27/10*** | (2006.01) |
| ***H01F 27/02*** | (2006.01) |
| ***H01F 27/32*** | (2006.01) |
| ***H01F 27/40*** | (2006.01) |

(52) U.S. Cl.
CPC ..... *H01F 27/322* (2013.01); *H01F 27/402* (2013.01); *H01F 2027/406* (2013.01)

(56) References Cited

U.S. PATENT DOCUMENTS

| | | | |
|---|---|---|---|
| 4,008,116 | A | 2/1977 | Sebel |
| 5,444,426 | A | 8/1995 | Sokai |
| 6,401,518 | B1 | 6/2002 | O'Keeffe et al. |
| 6,494,617 | B1 | 12/2002 | Stokes et al. |

FOREIGN PATENT DOCUMENTS

| | | | |
|---|---|---|---|
| DE | 19701269 | A1 | 7/1998 |
| JP | S5296313 | A | 8/1977 |
| JP | S5442620 | A | 4/1979 |
| JP | S5790921 | A | 6/1982 |
| JP | S60246608 | A | 12/1985 |
| JP | S61150309 | A | 7/1986 |

* cited by examiner

ELECTRICAL DEVICE HAVING ENCAPSULATED SPACES COOLED WITH DIFFERENT INTENSITY

BACKGROUND OF THE INVENTION

Field of the Invention

The invention relates to an electrical device for connecting to a high-voltage network, with a vessel, which is filled with an insulating fluid, an active part, which is arranged in the vessel and has a magnetizable core and partial windings for generating a magnetic field in the core, and a cooling device for cooling the insulating fluid.

Thus, for example, transformers or inductors which are connected to a high-voltage network each have a vessel which is generally filled with a mineral insulating oil as insulating fluid. In the case of a transformer, a low-voltage winding and a high-voltage winding are arranged in the vessel. The two windings are inductively coupled to one another via a magnetizable core. The insulating fluid serves for insulating the windings but also for cooling the transformer. For this purpose, the insulating oil warmed up during operation is passed via a cooling device fastened on the outside of the vessel to remove the heat. The cooling is set such that a maximum temperature of the insulating fluid is not exceeded, since otherwise the solid insulations of the transformer could be damaged.

Because the aging and lifetime of the solid insulation are to a great extent temperature-dependent, electrical devices of which the windings and winding constructions comprise combinations of insulating materials with different thermal capabilities have already been proposed.

In addition, alternative insulating fluids, such as ester oils or silicone oils, which have a higher temperature resistance, are increasingly being used in transformers. These alternative insulating fluids ensure greater fire safety and are, moreover, biodegradable. An improved environmental compatibility of insulating fluids is required in particular for offshore applications. By virtue of the improved thermal resistance of these alternative insulating fluids, the transformer can be operated at higher temperatures. In this connection, reference should be made to the standard IEEE 1276(1997).

In addition to the conventional insulating systems and materials, that is to say those which are currently predominantly used, so-called high-temperature insulations are known for electrical devices. However, the are cost-intensive. For this reason, so-called hybrid solutions, in which both high-temperature materials and insulations of customary materials are used, have been proposed. For example, the barrier system comprises conventional insulating materials, whereas the conductor winding insulation consists of high-temperature materials. However, the hybrid solutions have the disadvantage that, in spite of the use of costly high-temperature insulating materials, because of the conventional insulating materials that are still used the operating temperature of the insulating fluid lies considerably below the temperature that would be possible with the exclusive use of high-temperature insulating materials.

BRIEF SUMMARY OF THE INVENTION

The object of the invention is therefore to provide an electrical device of the type stated at the beginning which can be operated at higher temperatures, but at the same time remains cost-effective.

The invention achieves this object by means of at least one barrier system, which at least partially delimits encapsulated winding spaces, which are referred to hereinafter as encapsulating spaces, in which at least one partial winding is respectively arranged, the barrier system guiding the insulating fluid cooled by the cooling device across the encapsulating spaces in such a way that different temperatures of the insulating fluid and/or the partial windings occur in the encapsulating spaces.

According to the invention, a barrier system in interaction with the correspondingly designed cooling device ensures that at least two partial windings can be operated in different temperature portions, which are referred to here as encapsulating space temperatures. The barrier system in other words ensures that in the encapsulating spaces the insulating fluid and the winding have different temperatures. The encapsulating space temperature, that is to say the temperature region of the partial winding and/or of the insulating fluid in the respective encapsulating space, is expediently set such that a maximum operating temperature predetermined for this encapsulating space is not exceeded. It is possible in this way to use different insulating materials in the encapsulating spaces.

In addition, it is possible for example for the partial winding which is arranged in an encapsulating space in which a higher encapsulating space temperature occurs during normal operation of the electrical device to be designed to be low in insulating material. In this connection, the use of twisted mesh conductor windings is possible for example.

Enameled copper wires which are coated with different insulating coatings and can themselves withstand high temperatures are commercially available. This also applies for example to a wire with a coating of Pyre-ML polyimide, which is thermally resistant up to 220° C. By virtue of the small thickness of its coating layer, good heat dissipation from the wire to the insulating fluid is ensured.

By contrast, other partial windings which are arranged in an encapsulating space in which the insulating fluid has a lower encapsulating space temperature are expediently provided with the usual conventional, that is to say non-high-temperature-resistant, partial winding insulations or barrier systems. Thus, within the scope of the invention, the material of the barrier system may be different from encapsulating space to encapsulating space.

Within the scope of the invention, the encapsulating spaces are connected to one another, with the result that a hydraulic coupling is provided between them. The flow of the insulating fluid is preferably driven by way of a pump (OD cooling).

The barrier system expediently guides the insulating fluid through the encapsulating spaces one after the other, or in other words in series. The cooled-down, and consequently cold, insulating fluid consequently flows first into the first encapsulating space, and provides there the cooling of the partial winding arranged there. The insulating fluid thereby warms up and thus enters the next encapsulating space in the direction of flow, that is to say the second encapsulating space. If more than two encapsulating spaces are provided, insulating fluid flows from the second encapsulating space into the third encapsulating space, and so on. In each encapsulating space, the insulating fluid warms up a little, with the result that the encapsulating space temperature rises. In the last encapsulating space, the insulating fluid therefore has the highest encapsulating space temperature.

According to this variant of the invention, therefore, each encapsulating space is connected to a further encapsulating space, with the result that a series of encapsulating spaces arranged one behind the other in the direction of flow of the insulating fluid is formed, the first encapsulating space of said series forming an inlet opening and the last encapsulating space of said series forming an outlet opening. The encapsulating spaces consequently form a hydraulic series connection. The insulating fluid enters the encapsulating spaces connected in series through the inlet opening and leaves it through the outlet opening. The opening between two encapsulated spaces is referred to here as a connecting opening. The inlet opening and each connecting opening may be followed by a meandering system of ducts, which is formed by a labyrinthine barrier system. The barrier system advantageously also forms a labyrinth structure in the region of the inlet opening and/or connecting opening.

According to an advantageous further development, the barrier system encloses a partial winding at least in certain portions. The barrier system is for example partly of a hollow-cylindrical form and this part is arranged concentrically in relation to at least one partial winding.

The barrier system consists for example partially of pressboard, paper or some other cellulose. According to this variant of the invention, the barrier system serves both as a thermal barrier and as an electrical barrier.

In a preferred embodiment of the invention, an electrically required portion of the barrier system is incorporated in the formation of the encapsulating spaces as an encapsulation or insulating portion. Therefore, essential component parts of the encapsulation are formed by the corresponding design of the cylindrical, disk-shaped and curved portions of the electrical barriers. For this purpose, the usual horizontal barriers arranged in a meandering form are outwardly closed, with the result that the inflow and outflow of the insulating fluid with respect to the encapsulating spaces can only take place by way of defined inlet and outlet openings. Furthermore, in the case of this embodiment, the encapsulating spaces are fluidically connected to one another, in that the gap between the cylindrical portions of the barriers forming the encapsulation is used as a return duct for the insulating fluid. In the case of this configuration, the deflection and guidance of the flow of the insulating fluid takes place by corresponding design and connection of the curved regions of the barriers to the respectively adjoining cylindrical and disk-shaped portions of the barrier system. In regions and at transitions at which the number and the design of the electrically required barriers does not allow guidance and deflection of the flow of the insulating fluid, additional curved, cylindrical or disk-shaped barrier portions that guide the flow and seal the flow duct are inserted.

Advantageously, the gaps between the barriers of the encapsulating spaces that form a component part of the electrical barrier arrangement and in the case of this configuration are used as flow ducts for the diversion and return of the insulating fluid, are at least partially divided by further electrical barriers lying within the flow ducts into narrower partial gaps to increase the dielectric strength.

According to the invention, the partial winding with the greater high-voltage loading, that is to say with the higher proportion of insulating materials, is thus arranged in the region that is respectively upstream in terms of flow, that is to say the region with the colder insulating fluid.

Expediently, the first partial winding is a low-voltage winding and a second partial winding is a high-voltage winding. The two windings are arranged concentrically in relation to one another and for example also in relation to a core portion extending through the inner low-voltage winding. In other words, the electrical device according to this configuration of the invention is a transformer with concentric high-voltage and low-voltage windings as partial windings. The partial windings are advantageously configured as circumferentially closed cylindrical windings.

As already described further above, it is advantageous within the scope of the invention that the cooling device has a supply line, which forms an outlet opening arranged for example below the first partial winding and in particular below the high-voltage winding. According to this variant, the cooled-down insulating fluid is passed from the cooling device via the supply line directly into the encapsulating space of the first partial winding, with the result that the first partial winding is cooled with greater intensity than the further partial windings that are arranged downstream of the first partial winding in the direction of flow of the insulating fluid.

According to a preferred embodiment of the invention, insulations of different insulating materials are arranged in the encapsulating spaces. An insulation is to be understood here as meaning both the insulation of the partial winding arranged in the respective encapsulating space and the barrier system itself. Thus, the partial windings have for example different conductor insulations. The first partial winding is for example provided with a high-temperature insulation, whereas a second partial winding and all further partial windings have customary insulations of materials that are designed for lower temperatures. The materials of the barrier system may also be different from encapsulating space to encapsulating space. Within the scope of the invention, different insulating material may even be provided within one encapsulating space.

According to a further variant, the partial windings are designed for different operating voltages, the temperature of the insulating fluid and/or of the partial winding in the encapsulating space in which a partial winding designed for higher voltage is arranged being lower during normal operation of the electrical device according to the invention than the temperature of the insulating fluid and/or of the partial winding in the encapsulating space in which a partial winding designed for a comparatively lower voltage is arranged. The partial winding designed for higher voltages has a greater proportion of insulating material than the partial winding for lower voltages. In order to avoid expensive high-temperature insulating materials there, the cooled insulating fluid is first fed to the partial winding at which a higher voltage, for example in the range of several hundred kilovolts, occurs during normal operation.

Advantageously, the cooling device has a control unit with temperature sensors, the control unit having a threshold value for each temperature region and controlling the cooling output of the cooling device in dependence on the respective threshold value. The respective threshold value is for example determined in dependence on the respective class of the insulating materials of the partial windings. If the temperature sensed by the temperature sensors reaches the threshold value, the control unit for example activates a circulating pump of the cooling device, and thus increases its cooling output. Advantageously, each temperature region of a partial winding is provided with a sensor.

According to an expedient further development in this respect, the temperature sensors are designed for sensing the temperature of a partial winding and/or for sensing the temperature of the insulating fluid in a partial winding.

In a further variant, the barrier system has at least one insulating portion that is designed for reducing electrical field strengths.

According to a further variant, the barrier system delimits vertical flow ducts running parallel to one another with opposite directions of flow, at least one of the vertical flow ducts being arranged as a return duct between insulating portions respectively surrounding a partial winding. In the case of this variant, the cooled insulating fluid flows for example from the bottom upward through the first vertical flow duct. Its flow is consequently directed in the same sense as the proper motion of the insulating fluid caused by warming up.

It is of course possible within the scope of the invention to provide a number of parallel flow ducts. These may be horizontal or vertical ducts. During operation, the insulating fluid can flow through adjacent flow ducts in the same direction. The flow ducts may be delimited by the insulating portions, or in other words by portions of the barrier system that serve for the electrical insulation of the partial windings. Within the scope of the invention, the embodiment of the flow ducts is possible in various ways.

Advantageously, ducts between the barriers that are not required for the specifically directed fluid flow are closed by shims to avoid the formation of a bypass.

In a preferred embodiment of the invention, the main flow of the insulating fluid within the encapsulating spaces takes place from the bottom upward, is therefore directed in the same sense as the proper motion of the insulating fluid caused by warming up. Outside the encapsulating spaces, the insulating fluid is diverted to a further insulating portion. In these regions without a heat source, the flow takes place from the top downward, in order subsequently in a further encapsulating space in turn to flow from the bottom upward in a way identical to the thermal proper motion of the insulating fluid.

Advantageously, a wall of the barrier system between vertical flow ducts running parallel to one another with opposite directions of flow has a thermal insulation. An increased wall thickness with respect to the remaining component parts of the barrier system or else a thermal coating comes into consideration for example as the thermal insulation.

Advantageously, at least one partial winding forms temperature regions in which insulating materials that have differing degrees of thermal loadability are arranged. The insulating materials are for example respectively assigned to different thermal classes.

According to a variant in this respect, each temperature region provided with different insulating materials is provided with a thermal sensor for measuring the hotspot temperature of the respective temperature region. The sensors are connected to a control unit, which monitors the hotspot temperature for each temperature region. For this purpose, each temperature region is assigned threshold values to match the insulating materials that are respectively used.

In a further variant of the invention, a barrier system is designed in such a way that cooling ducts of the magnetic core are included in the forced flow of the insulating fluid.

In the case of a variant of the invention, a gradation of the temperature classes for the insulating components according to their thermal loading also takes place within a temperature region of a partial winding. Consequently, for example, the conductor insulation is designed according to the hotspot temperature of the respective temperature region. Insulating components within the respective temperature region which however maintain a certain distance from the hottest spots of the respective partial winding can be configured in a lower thermal class if the corresponding temperature gradient so allows.

Consequently, gradations of the thermal stability may be provided in the following sequence:

1. Conductor insulation
2. Spacers in contact with the conductor (riders, shims, bars)
3. Potential control rings and barriers (cylinder barriers, angle rings, caps, bars between the barriers)

Winding parts, in particular winding end leads, with more sophisticated insulation are preferably arranged in the region where the insulating fluid enters the corresponding winding portion.

Partial windings which, due to their geometry or technical design, are not suitable for being included in the fluidic series connection described may also form separate concentrically arranged winding assemblies.

According to the invention, operation at higher temperatures is made possible, while there is no need for a costly changeover for example of the winding parts high in insulating material of a high-voltage winding to high-temperature insulating materials. In addition, a higher current density in the winding conductors, and thus a considerable reduction in the overall size, are possible. Within the scope of the invention, an increase in the temperature of the insulating fluid leads to a considerable increase in the temperature difference with respect to the external cooling medium, such as for example air or water. Consequently, the effectiveness of the cooling increases considerably, with the result that the electrical device according to the invention can be configured more compactly.

On account of the high viscosity of ester- and silicone-based insulating fluids, flow-related and cooling-related advantages during operation at higher temperatures are also obtained. An optimization of the losses for normal load becomes possible, with provision of a high overload allowance. For certain applications, the high temperature span of the insulating liquid allows the effective use of external evaporative coolers and coolers based on heat pipes.

BRIEF DESCRIPTION OF THE SEVERAL VIEWS OF THE DRAWING

Further expedient embodiments and advantages of the invention are the subject of the following description of exemplary embodiments of the invention with reference to the figures of the drawing, in which FIGS. 1 to 4 schematically illustrate exemplary embodiments of the electrical device according to the invention in a side view.

DESCRIPTION OF THE INVENTION

Figure 1:
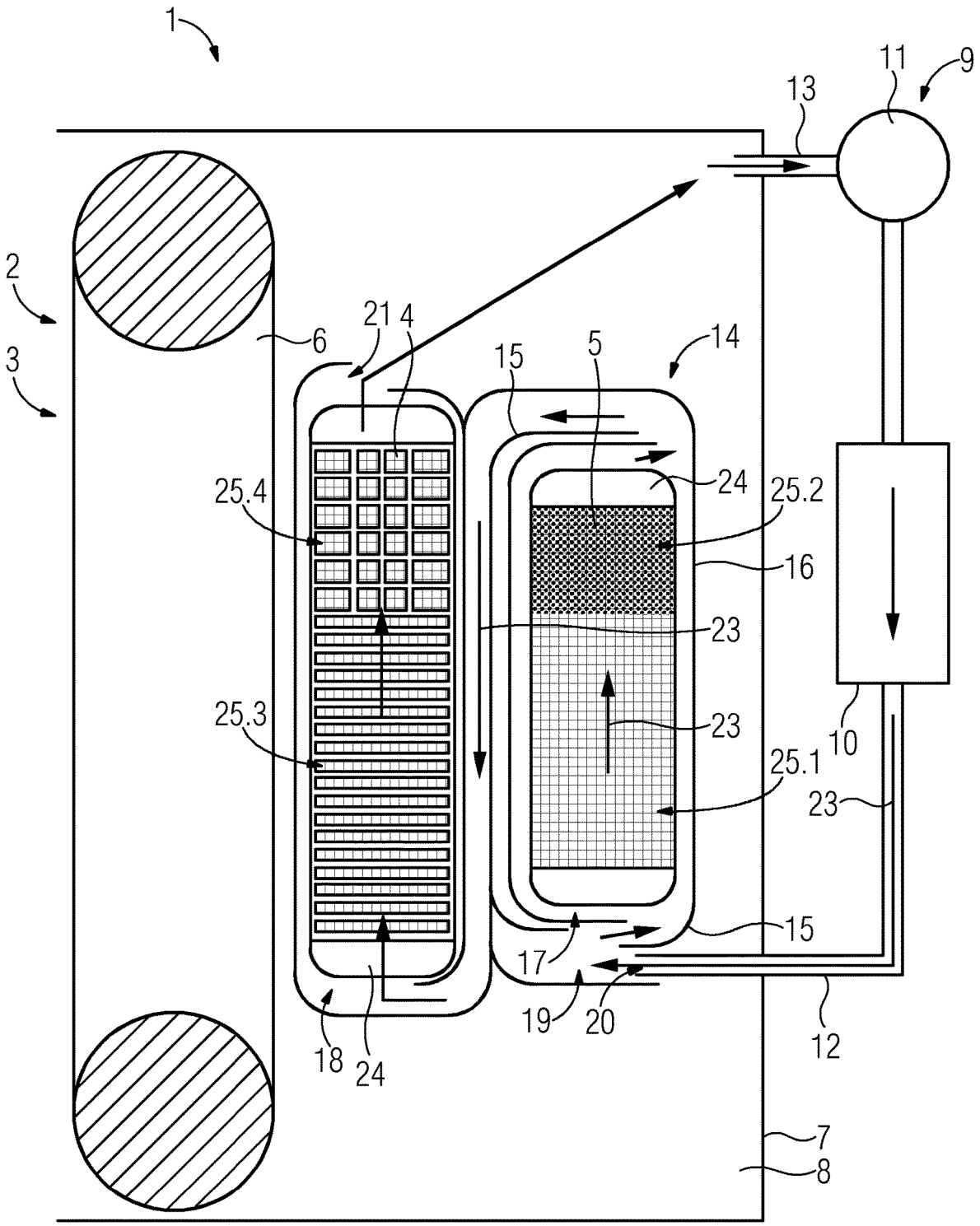

FIG. 1 of the drawing shows an exemplary embodiment of the electrical device 1 according to the invention, which is configured as a transformer 1. The transformer 1 has an active part 2, which is formed by a core 3, a low-voltage winding 4 and a high-voltage winding 5. The low-voltage winding 4 and the high-voltage winding 5 are arranged concentrically in relation to a leg 6 of the core 3, only one side of the windings being illustrated in FIG. 1. It should however be noted that both the low-voltage winding and the high-voltage winding run around the leg 6 as partial windings in a circumferentially closed manner, that is to say in the form of a ring.

The active part 2 is arranged within a vessel 7, which is filled with an insulating fluid 8, in the exemplary embodiment shown a vegetable ester. Fastened on the vessel 7 is a cooling device 9, which has a cooling register 10, a circulating pump 11, a supply line 12 and a return line 13. The transformer 1 is intended for connection to a high-voltage network, with the result that, during the operation of the transformer, the high-voltage winding 5 is at a high-voltage potential, that is to say is subjected to a voltage of over 50 kV. A barrier system 14, which almost completely encloses both the low-voltage winding 4 and the high-voltage winding 5 respectively with one of its insulating portions, serves for controlling the electrical field thereby occurring. The barrier system 14 is at least partially produced from pressboard or some other cellulose-based material and has curved portions 15 and cylindrical portions 16, which are arranged in relation to one another in such a way that the high-voltage winding 5 and the low-voltage winding 4 are respectively arranged in encapsulating spaces 17 and 18, which are fluidically connected to one another. The encapsulating spaces 17, 18 are not completely fluid-tight. Some insulating fluid 8 can therefore also leave the barrier system 14 from the inside to the outside above the high-voltage winding 5. These "unintentionally" escaping amounts of fluid can however be ignored with regard to the cooling. The main proportion of the flow of the insulating fluid is guided through the barrier system 14. In this case, the barrier system 14 forms under the high-voltage winding 5 an inlet opening 19, through which the cooled insulating fluid escaping from the supply line 12 of the cooling device 9 enters the barrier system 14. In addition, the barrier system 14 also forms an outlet opening 21, which in the example shown is arranged above the low-voltage winding 4. The encapsulating spaces 17 and 18 are in addition hydraulically coupled to one another.

The circulating pump 11 ensures that the insulating fluid 8 flows through the active part 2 and the vessel 7 in the direction illustrated by flow arrows 23. Each partial winding 4 and 5 has grading rings 24, which are arranged at its upper and lower ends for field control.

By circulating by means of the circulating pump 11, the insulating fluid 8, that is to say the ester, is guided over the cooling register 10 and cooled down, cooled insulating fluid 8 leaving the outlet opening 20 of the supply line 12 entering the barrier system 14 through the inlet opening 19. There, the insulating fluid 8 is deflected a number of times, that is to say is guided in a meandering form, until it reaches the lower end of the high-voltage winding 5, in which cooling ducts are formed. In these cooling ducts, which are not represented in the figures, the lost heat of the high-voltage winding 5 is transferred to the insulating fluid 8 flowing through the cooling ducts. This causes a continual warming up of the insulating fluid 8. The high-voltage winding 5 forms two temperature regions 25.1 and 25.2, which are indicated in FIG. 1 by a different patterning. In these temperature regions 25.1 and 25.2, the winding 5 is provided with different insulating materials, which are for example assigned to different thermal classes.

The gradually warming-up insulating fluid 8 enters the encapsulating space 18 of the low-voltage winding 4 from the encapsulating space 17 of the high-voltage winding 5. The barrier system 14 then guides the insulating fluid 8 over the low-voltage winding 4, which likewise has cooling ducts and temperature regions 25.3 and 25.4 with different insulating materials. Finally, the insulating fluid 8, which is once again warmed up here, passes through the outlet opening 21 into the interior space of the vessel. From there, the insulating fluid 8 is supplied once again to the cooling register 10 by way of the return line 13 and the circulating pump 11. The cooling cycle begins once again.

Since the insulating fluid 8 is guided through the encapsulating spaces 17 and 18 one after the other, different encapsulating temperature regions form in the temperature regions 25.1, 25.2, 25.3 and 25.4. Thus, the encapsulating space temperature, that is to say the temperature of the winding 5 and of the insulating fluid 8, in the temperature region 25.1 is on average lower than in the temperature region 25.2 and in particular than in the temperature regions 25.3 and 25.4.

Unnecessary costs are avoided by the arrangement of insulating materials with different heat resistance in the respectively appropriate temperature regions of the partial windings.

An exemplary assignment of the thermal classes to the winding regions 25.1-25.4 represented in the exemplary embodiment is indicated below. In the exemplary embodiment, an ester oil is used as the insulating fluid.

Design example of the partial windings 4, 5 as shown in FIG. 1 (thermal classes of the insulating materials in accordance with EN 60085:2008)

| Temperature region | 25.1 | 25.2 | 25.3 | 25.4 |
|---|---|---|---|---|
| Conductor insulation | E (120° C.) | B (130° C.) | F (155° C.) | H (180° C.) |
| Spacer | A (105° C.) | E (120° C.) | B (130° C.) | F (155° C.) |
| Barrier system/potential control rings | A (105° C.) | A (105° C.) | E (120° C.) | B (130° C.) |

Spacers comprise: Radial and axial spacers (bars, riders intermediate layers)
Barrier system comprises: Barriers, angle rings, caps, disks, insulating cylinders The gradation of the thermal capability of the insulating materials can also be undertaken within the thermal classes in accordance with EN 60085, a large number of possibilities existing here, with for example a gradation in temperature increments of less than 10 K also being possible.

Figure 2:
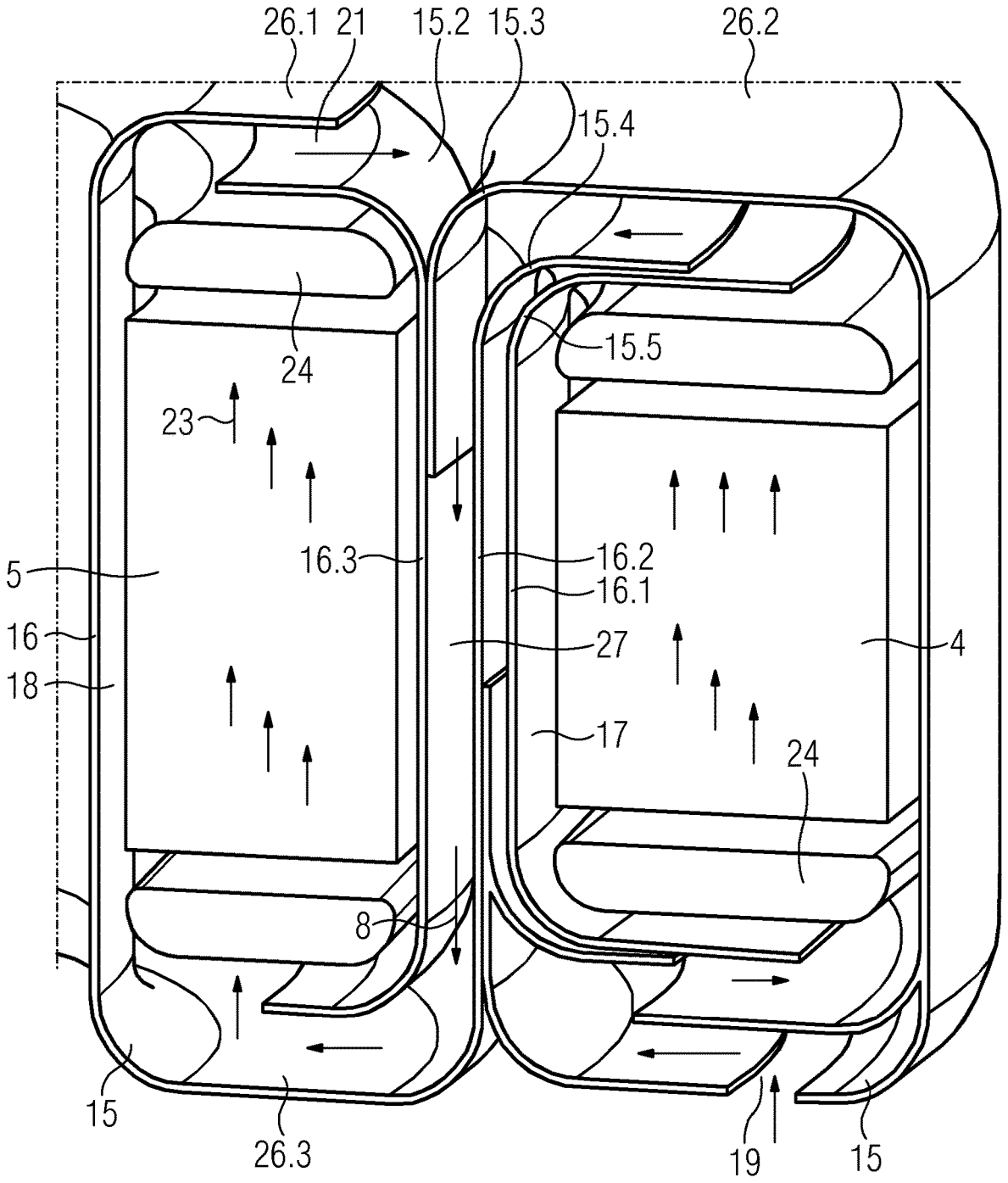

FIG. 2 shows an exemplary embodiment of the electrical device 1 according to the invention represented in a simplified form, the barrier system 14 being particularly clear to see. The barrier system 14 is designed to the extent that it can be used for guiding and deflecting the flow of the insulating fluid 8. For this purpose, the barrier system 14 again has cylindrical portions 16, 16.1, 16.2, 16.3, disk-shaped portions 26.1, 26.2, 26.3 and curved portions 15, 15.1, 15.2, 15.3 and 15.4, the latter also being referred to as angle rings or caps.

According to the invention, the barrier system 14 is designed in such a way that encapsulated winding spaces form, referred to here as encapsulating spaces 17, 28. For this purpose, the usually present, outer horizontal disk-shaped barriers, that delimit a flow duct for the insulating fluid are replaced by closed disks 26.2, 26.3, with the result that the inflow and outflow of the insulating fluid 8 into and out of the encapsulating spaces 17 and 18 takes place in a controlled manner by way of the inlet opening 19 and outlet opening 21. In this case, the encapsulating spaces 17 and 18 are fluidically connected to one another, in that the gap between the cylindrical portions 16.2 and 16.3 is used as a return duct 27 for the insulating fluid. In the exemplary embodiment, the inlet opening 19 is formed in the so-called winding base.

The outlet opening 21 lies in the disk-shaped portion 26.1. In the exemplary embodiment shown, the gap between the curved portions 15.3 and 15.4 is used for deflecting the flow 23, or in other words reversing the direction of the flow 23, of the insulating fluid 8.

In terms of high voltage, the construction of closed barrier surfaces as perpendicularly as possible to the direction of the field should be preferred. Advantageously, the curved barriers should also accordingly follow approximately the path of the equipotential lines. The resultant largely parallel arrangement also of the curved portions 15, 15.2 is conducive to use as a flow duct 27 for deflecting the flow of the insulating fluid 8, with the result that only slight flow-related changes are necessary. At transitions at which the number of electrically required curved barrier portions 15.4, 15.5 do not allow a reversal of the direction of the flow of the insulating fluid, additional curved barriers 15.3 that guide the flow and outwardly seal the winding space are inserted.

In the exemplary embodiment shown, an additional curved barrier 15.3 that serves for diverting the flow of the insulating fluid has the effect of an overlaying of a number of solid insulations at the interface between the cylindrical and curved barrier portions. To avoid unfavorable field conditions due to an excessive overall thickness of the solid insulations forming the electrical barrier, at the interface between the curved barriers and the cylindrical barriers respectively scarfed angle rings 15.2 and unscarfed angle rings of a small wall thickness 15.3 are arranged in a combined and opposing manner at the cylindrical portion 16.3.

Figure 3:
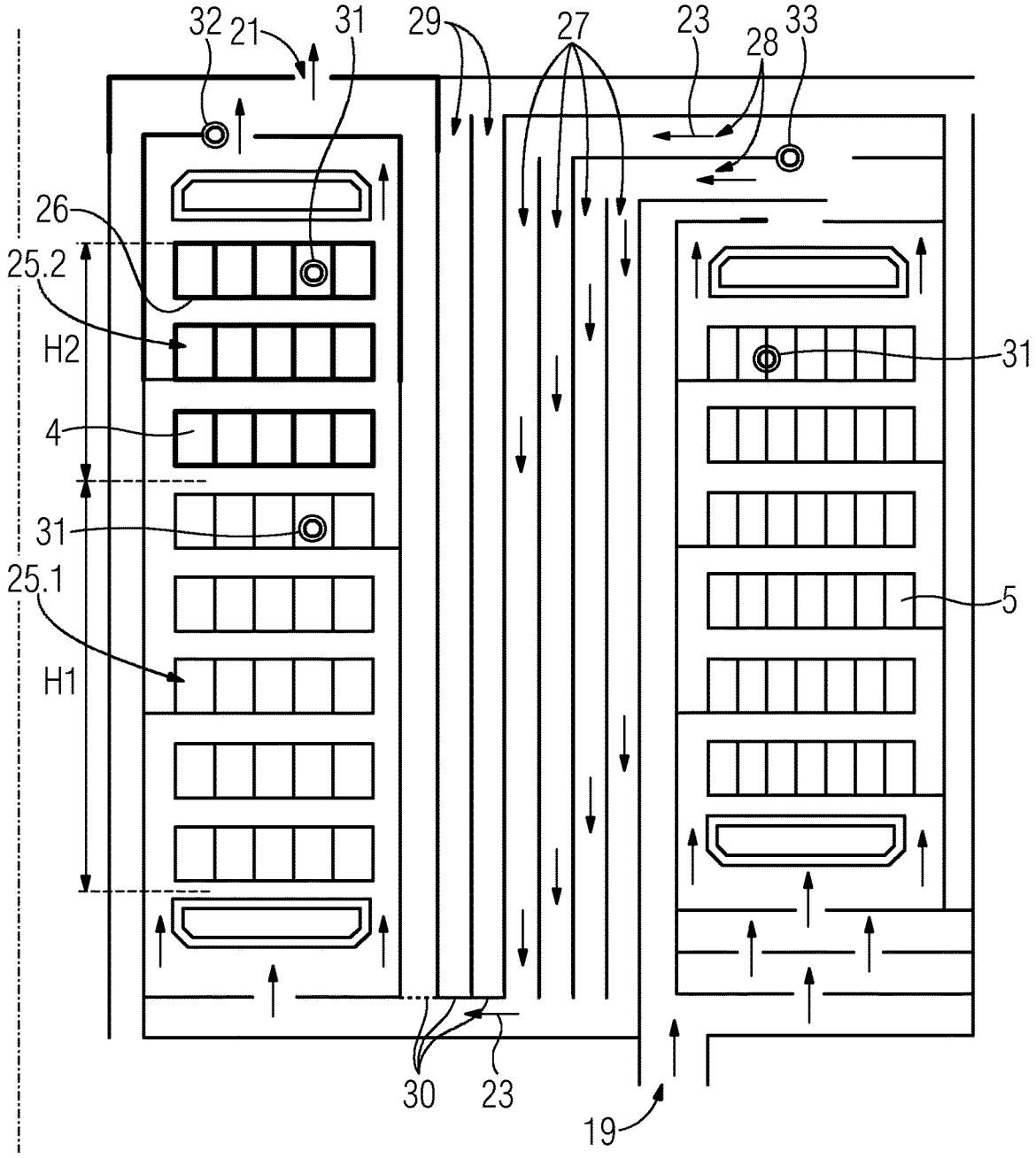

FIG. 3 shows an exemplary embodiment in which only one of the encapsulating spaces 17, 18 has a partial winding with a number of temperature regions 25.1 and 25.2. The thermal class of the conductor insulation 26 increases from encapsulating space 17 to encapsulating space 18 and in the latter in turn from temperature region 25.1 to temperature region 25.2. The transition of the temperature regions takes place after reaching a winding height H1.

To increase the dielectric strength, it is known that the oil gaps of the insulating construction are divided by the barrier system 14 into narrower vertical ducts 27 and horizontal ducts 28. According to the invention, these ducts 27, 28 are used for conducting the insulating fluid 8 to the partial winding 4 arranged downstream in the direction of flow 23. In the exemplary embodiment, a number of these ducts 27, 28 extend parallel to one another, in order to achieve the cross section required for the flow of the insulating fluid 8. The cross section or exact cross-sectional area and the number of interconnected vertical ducts 27 and horizontal ducts 28 may deviate from one another within the scope of the invention. To avoid bypasses, the ducts 29, which are not used as flow ducts, may be completely or partially closed at the lower end by shims 30 of insulating material.

In the exemplary embodiment shown, traditional disk windings are represented within the temperature regions 25.1 and 25.2. The insulating fluid 8 flows from an outer vertical duct through a number of horizontal ducts into a second outer duct, where the direction of flow of the insulating fluid 8 is deflected, so that the insulating fluid 8 continues to flow in the opposite direction, with the result that the direction of flow changes a number of times along the height of the winding. The embodiment according to the invention of the barrier system 14 and insulation is however analogously transferable to all other types of winding.

In the exemplary embodiment shown, the partial windings are provided with thermal sensors 31 at so-called hotspots of their respective temperature regions 5, 25.1 and 25.2. The sensors 31 are connected to a control unit that is not represented in the figures.

Arranged at the outlet opening 21 of the last partial winding 4 thermally connected in series is a further sensor 32 for measuring the maximum temperature of the insulating fluid 8. If need be, checking the maximum temperature of the insulating fluid 8 in the upstream partial winding 5 is also possible by way of the sensor 33.

Figure 4:
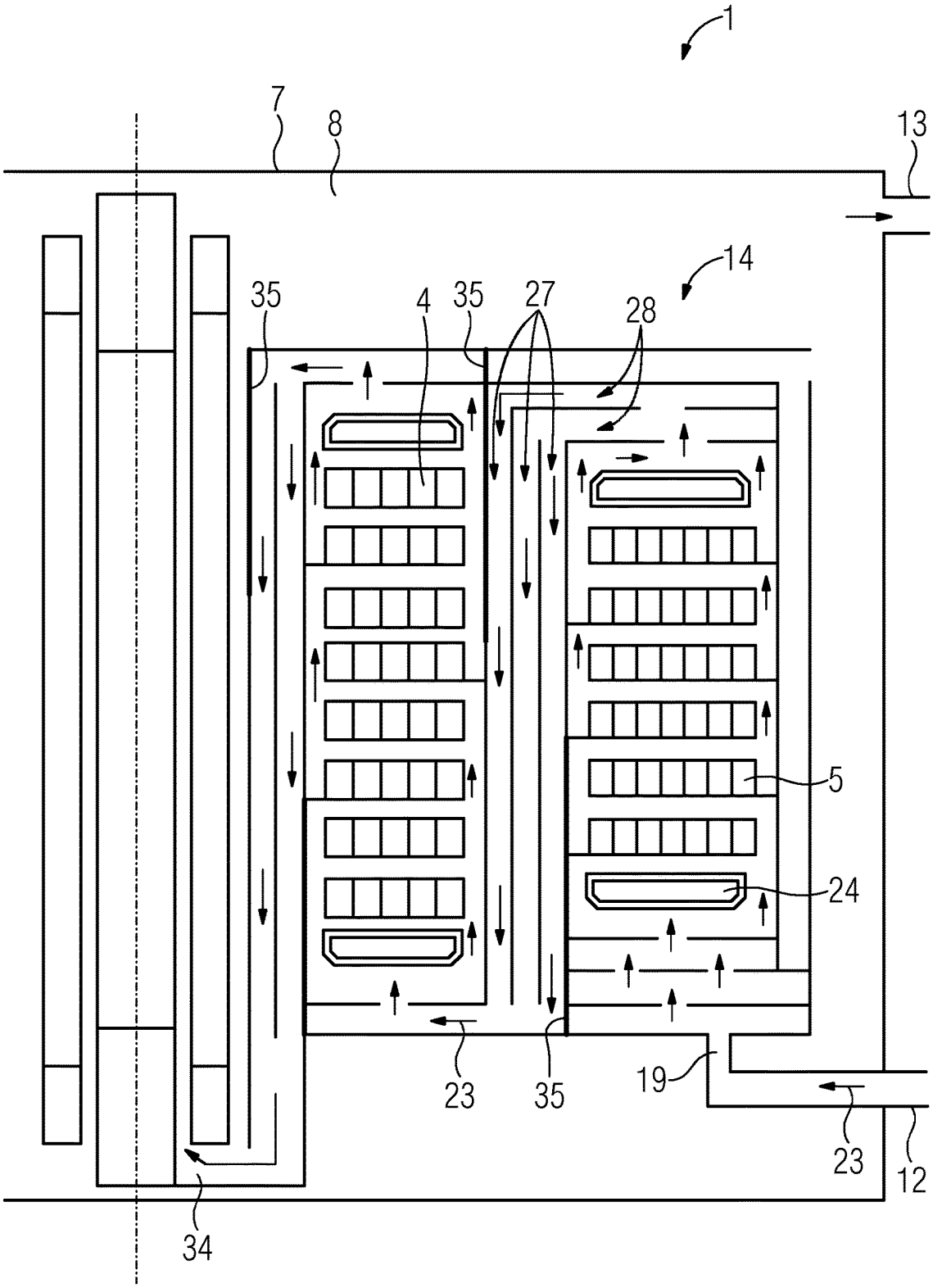

FIG. 4 shows an exemplary embodiment in which the core 3 is incorporated in the cooling circuit. This is advantageous when a great temperature span of the insulating fluid 8 is provided. Designing the core 3 for higher temperatures requires only a very small effort since no moldings are required and an electrical field loading does not have to be taken into consideration. Therefore, the core 3 is put at the end of the fluidic series connection of the components to be cooled of the electrical device 1. In the exemplary embodiment as shown in FIG. 4, the windings 5 and 4 are flowed through by the insulating fluid 8 one after the other, and subsequently the core 3. The cooling ducts of the partial windings 4, 5 and cooling ducts 34 of the core 3 are thermally and fluidically connected in series. In the exemplary embodiment, the barriers are designed such that the main flow of the insulating fluid 8 within the encapsulating spaces 17 and 18 and in the core 3 is in each case directed from the bottom upward, that is to say directed in the same sense as the proper motion of the insulating fluid 8 caused by warming up. The return of the insulating fluid 8 takes place in each case in the vertical ducts 27 between the barriers of the insulating arrangement, which are referred to here as insulating portions of the barrier system 14.

In the exemplary embodiment, the vertical portions 16 of the barrier system 14, which delimit ducts 27 with opposed directions of flow, are provided with an additional thermal insulation 35 in regions with a high temperature difference of the insulating fluid 8. In the simple case, this may take place by increasing the wall thickness. In the regions near the reversal in the direction of the insulating fluid 8, the temperature difference is small. Therefore, no measures are required there.

The invention claimed is:

1. An electrical device for connecting to a high-voltage network, the electrical device comprising:

a vessel filled with an insulating fluid;

an active part disposed in said vessel, said active part having a magnetizable core and partial windings for generating a magnetic field in said core; and a cooling device for cooling the insulating fluid;

a barrier system disposed to at least partially delimit encapsulating spaces, in which at least one of said partial windings is respectively arranged, the barrier system guiding said insulating fluid cooled by the cooling device across said encapsulating spaces to cause different temperatures of the insulating fluid and/or of said partial windings in said encapsulating spaces; and each said encapsulating space being connected to a further encapsulating space, to thereby form a series of encapsulating spaces arranged one behind another in a direction of flow of the insulating fluid, with a first encapsulating space of said series forming an inlet opening and a last encapsulating space of said series forming an outlet opening;

said barrier system having core connecting ducts formed therein, which extend from an encapsulating space arranged last in the direction of flow of the insulating fluid, and cooling ducts of said core.

2. The electrical device according to claim 1, wherein said barrier system is disposed to guide the insulating fluid through said encapsulating spaces one after another.

3. The electrical device according to claim 1, wherein said partial windings include a first partial winding being a low-voltage winding and a second partial winding being a high-voltage winding, said first and second partial windings being arranged concentrically in relation to one another and in relation to a core portion extending through an inner said winding being said low-voltage winding.

4. The electrical device according to claim 1, wherein insulations of different insulating materials are arranged in said encapsulating spaces.

5. The electrical device according to claim 1, wherein said partial windings are designed for different operating voltages, a temperature of the insulating fluid and/or of said partial winding in a respective said encapsulating space in which a partial winding designed for higher voltage is arranged being lower during normal operation than a temperature of the insulating fluid and/or of said partial winding in a respective said encapsulating space in which a partial winding designed for a comparatively lower voltage is arranged.

6. The electrical device according to claim 1, wherein said cooling device has a control unit with temperature sensors, said control unit having a threshold value for each encapsulating space or each temperature region (25.1-25.4) of one of said partial windings and being configured for controlling a cooling output of said cooling device in dependence on a respective threshold value.

7. The electrical device according to claim 6, wherein said temperature sensors are configured for sensing a temperature of a partial winding and/or for sensing a temperature of the insulating fluid in a partial winding.

8. The electrical device according to claim 1, wherein said barrier system comprises at least one insulating portion configured for reducing electrical field strengths.

9. The electrical device according to claim 8, wherein said barrier system delimits vertical flow ducts running parallel to one another with opposite directions of flow, at least one of said vertical flow ducts being arranged as a return duct between insulating portions respectively surrounding a partial winding.

10. The electrical device according to claim 9, wherein a wall of said barrier system between respective said vertical flow ducts running parallel to one another with opposite directions of flow has a thermal insulation.

11. The electrical device according to claim 1, wherein at least one partial winding forms temperature regions in which insulating materials that have differing degrees of thermal loadability are arranged.

12. The electrical device according to claim 11, wherein at least two said temperature regions are respectively provided with a thermal sensor for measuring a hotspot temperature of said at least one winding in the respective said temperature region.

13. The electrical device according to claim 1, wherein said barrier system forms flow ducts that run parallel to one another at least in certain portions.

* * * * *